United States Patent [19]

Waldo

[11] 4,063,765

[45] Dec. 20, 1977

[54] AUTOMATICALLY LOCKING CROSSBOLT DEADLOCK

[75] Inventor: Russell W. Waldo, St. Paul, Minn.

[73] Assignee: Ideal Security Hardware Corporation, St. Paul, Minn.

[21] Appl. No.: 699,504

[22] Filed: June 24, 1976

Related U.S. Application Data

[63] Continuation of Ser. No. 521,291, Nov. 6, 1974, abandoned, and a continuation-in-part of Ser. No. 477,148, June 6, 1974.

[51] Int. Cl.[2] ..... E05C 1/16

[52] U.S. Cl. ..... 292/335

[58] Field of Search ..... 292/334, 335, 336, 150, 292/332

[56] References Cited

U.S. PATENT DOCUMENTS

| | | | |
|---|---|---|---|
| 1,162,406 | 11/1915 | Segal | 292/335 |
| 1,330,693 | 2/1920 | Fisher | 292/335 |
| 2,158,088 | 5/1939 | Segal | 292/335 |
| 2,279,591 | 4/1942 | Heyer | 292/335 |
| 2,293,363 | 8/1942 | Schell | 292/335 |
| 2,344,451 | 3/1944 | Pankhurst | 292/335 |
| 2,660,752 | 12/1953 | Carcereny | 292/335 X |
| 2,995,394 | 8/1961 | Browning | 292/335 X |

*Primary Examiner*—Richard E. Moore

*Attorney, Agent, or Firm*—Merchant, Gould, Smith, Edell, Welter & Schmidt

[57] ABSTRACT

A crossbolt deadlock having a crossbolt yieldingly urged toward a locking position relative to a cooperating strike. An actuator lever releasably holds the crossbolt in an unlocking position and has a portion engaging the strike, upon closing of the door on which the deadlock is mounted, to automatically release the crossbolt for movement into locking engagement with the strike. A spring yieldingly urges the actuator lever toward holding engagement with the crossbolt. A lock member is movable to positively lock the crossbolt selectively in locking or unlocking positions.

2 Claims, 8 Drawing Figures

AUTOMATICALLY LOCKING CROSSBOLT DEADLOCK

This is a continuation of application Ser. No. 521,291, filed Nov. 6, 1974, now abandoned.

This is a continuation-in-part of my co-pending application entitled "Automatically Locking Crossbolt Deadlock" which was filed on June 6, 1974, under Ser. No. 477,148.

BACKGROUND OF THE INVENTION

This invention relates generally to door latches and locks, and more particularly to improvements in crossbolt locks generally of the type disclosed in U.S. Pat. No. 3,746,380 and 3,760,619, assigned to the assignee company of this invention. Crossbolt door locks are usually in the nature of deadlocks due to the fact that the crossbolts are manually moved to both their locked and unlocked positions. These locks are usually stronger and more tamper proof than are the customary latch bolts.

SUMMARY OF THE INVENTION

The deadlock of this invention comprises; a housing for mounting on a door, a crossbolt mounted in the housing for movements between locked and unlocked positions, a cooperating strike adapted to be mounted on a door frame and having at least one apertured lug for reception of the crossbolt, and a handle for moving the crossbolt from its locked or unlocked position. A spring urges the crossbolt in a direction of its movement toward its locked position, and an actuator is mounted in the housing for engagement with the crossbolt to releasably hold the crossbolt in its unlocked position. The actuator includes a portion which is disposed to engage the strike when the door is closed, and moved by the strike to automatically release the crossbolt for movement into locking engagement with the strike. Once locked, the lock can be opened by means of the handle from the interior of the building or room and only by means of a proper key from the exterior, as is customary. A lock member is mounted on a wall of the housing for movements toward and away from engagement of a portion thereof with a selected one of a pair of spaced portions of the crossbolt, to positively lock the crossbolt in a selected one of its locking or unlocking positions.

DETAILED DESCRIPTION OF THE PREFERRED EMBODIMENT

Figure 1:
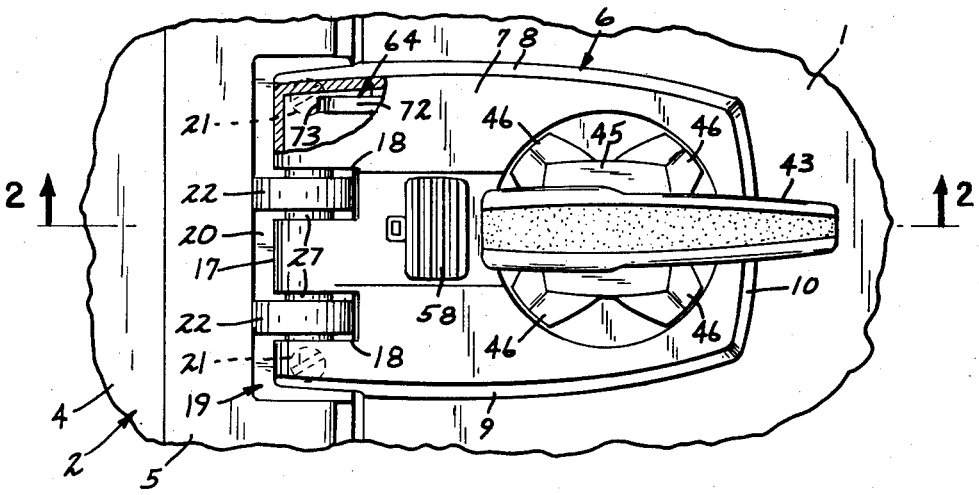
FIG. 1 is a fragmentary view in side elevation of a door and a cooperating door frame, with the crossbolt lock of this invention being mounted thereon, some parts being broken away and some parts being shown in section.

A conventional hinged door is shown fragmentarily, and indicated by the numeral 1, being mounted for swinging movements in a usual type of door frame, indicated generally at 2 for opening and closing movements toward a stop strip 3 formed as part of an upright frame member or stile 4 of the door frame 2. A molding 5 also forms a part of the door frame 2.

Figure 2:
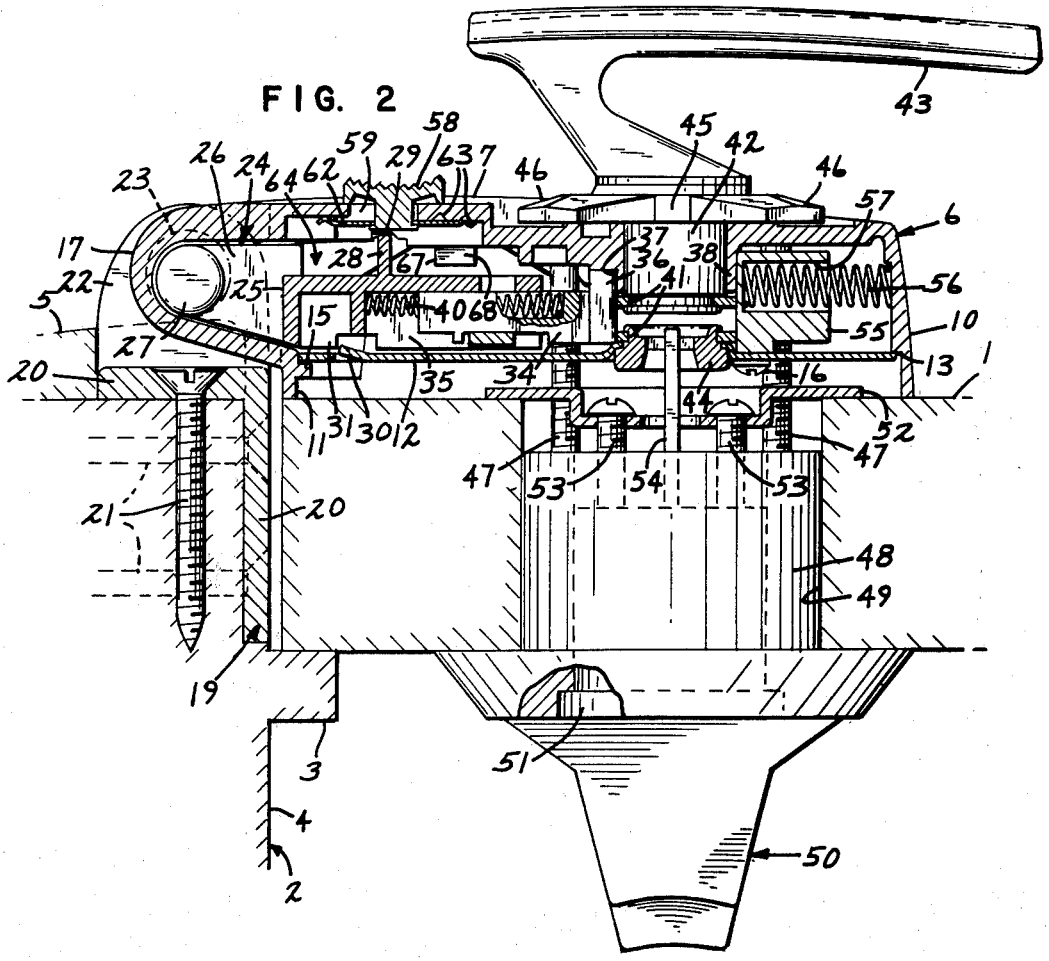
FIG. 2 is an enlarged fragmentary section taken substantially on the line 2—2 of FIG. 1.

The present door lock involves a housing 6 including an outer or front wall 7, top and bottom walls 8 and 9 respectively, and opposite end walls 10 and 11. The inner or rear portion of the housing is formed by a removable plate-like wall member 12 that engages shoulder portions 13 and 14 on the interiors of the end wall 10 and top and bottom walls 8 and 9, and lips 15 on the end wall 11, see partucularly FIGS. 2 and 3. The wall member 12 is securely held in place by a machine screw 16 threaded into a portion of the front wall 7. The end wall 11 is formed to provide a longitudinally outwardly projecting nose portion 17 that is cut away to provide a pair of vertically spaced slot-like notches or openings 18 to the interior of the housing 6. As shown, when the door 1 is closed against the stop strip 3, the nose portion 17 of the housing 6 projects outwardly from the adjacent edge of the door 1 and over a portion of the door frame member or stile 4. A strike 19 includes a base portion 20 that is rigidly secured to the stile 4 by screws or the like 21, and a pair of vertically spaced lugs 22 that are positioned to be received within respective ones of the notches or openings 18 of the housing 6, when the door is closed. The lugs 22 are provided with axially aligned apertures 23 that are disposed to communicate with the interior of the housing nose portion 17 when the door 1 is closed.

A crossbolt 24 is mounted in the housing 6 for reciprocatory movement in a generally vertical direction, and comprises a main body portion 25, a pair of vertically spaced arms 26 that project laterally into the interior of the housing nose portion 17, and a pair of axially aligned bolt portions 27 that extend in a direction parallel to the direction of movement of the crossbolt 24 to move transversely into and out of respective ones of the notches 18 and, when the door 1 is closed, into one of the apertures 23 of a different one of the strike lugs 22. The crossbolt body 25 is formed to provide a lug or rail 28 that is elongated in the direction of movement of the crossbolt 24 and which is slidably contained in a guide channel or groove 29 formed in the inner surface of the front wall 7. The platelike wall member 12 is formed to provide an inturned flange 30 that slidably engages a portion 31 of the crossbolt body 25, to assist in guiding the crossbolt 24 in its movements.

Figure 3:
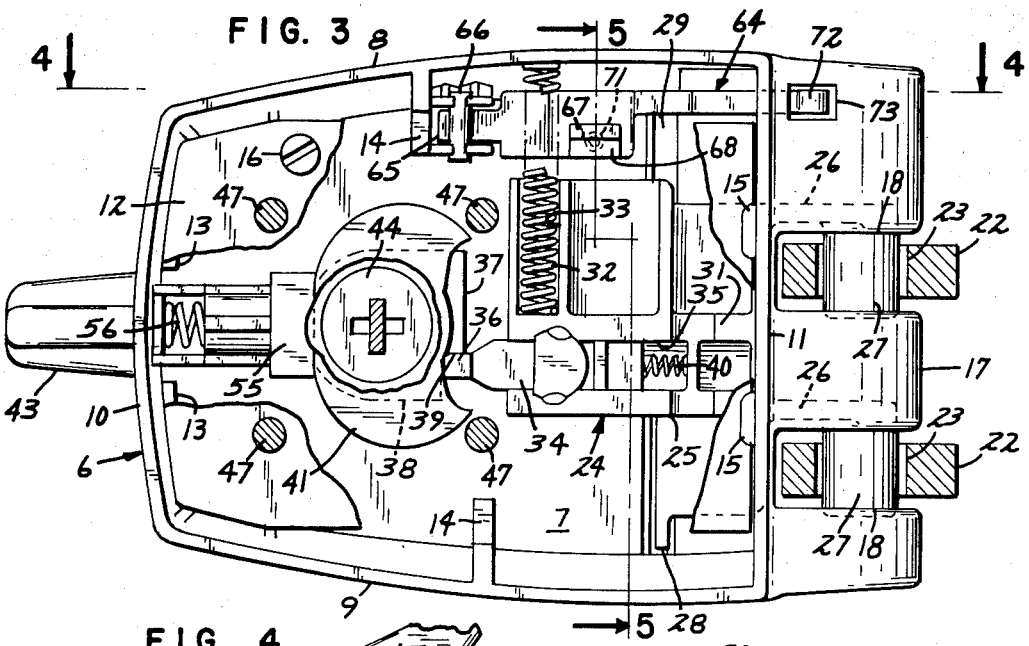
FIG. 3 is an enlarged view in elevation of the side of the lock opposite that shown in FIG. 1, some parts being broken away and some parts being shown in section.
Figure 4:
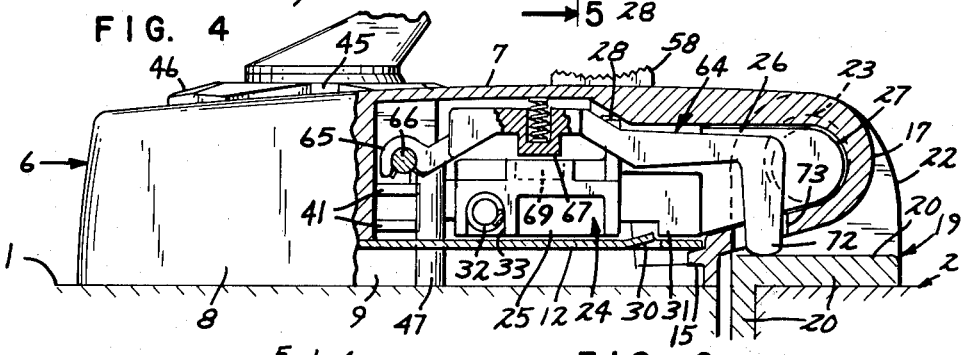
FIG. 4 is a view partly in plan and partly in section, taken on the line 4—4 of FIG. 3.
Figure 5:
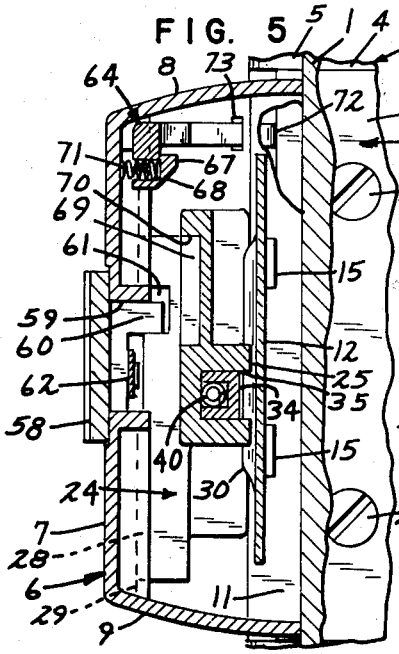
FIG. 5 is a fragmentary section taken on the line 5—5 of FIG. 4.

The crossbolt 24 is yieldingly urged to its locked position shown in FIGS. 1 and 3-5, by a coiled compression spring 32 having one end engaging the upper housing wall 8 and its opposite end portion contained in a recess 33 in the bolt body portion 25. With reference particularly to FIG. 3, it will be seen that when the crossbolt 24 is in its locked position, the bolt portions 27 are extended completely through their respective strike apertures 23 and their respective notches or openings 18. The crossbolt 24 is releasably held in its locked position by means of a retainer member 34 that is mounted in a transverse recess 35 in the crossbolt body portion 25 for movements transversely of the direction of movement of the crossbolt 24. The retainer member 34 is formed to provide a head 36 that slidably engages a side surface 37 of a hub 38 integrally formed with the housing 6. The hub 38 is notched to provide a shoulder 39 for engagement with the head 36 to hold the crossbolt 24 against movement in an unlocking direction. The retainer member 34 is yieldingly urged toward engagement of the head 36 thereof with the surface 37 and shoulder 39 of the hub 38 by means of a coil compression spring 40.

Means for retracting the retainer member 34 to disengage the head 36 thereof from the shoulder 39 against yielding bias of the spring 40, and to move the crossbolt 24 out of interlocking engagement with the strike 19, comprises a pair of spaced cams 41, one of which is mounted on a shaft 42 that is journaled in the hub 38, the shaft 42 extending through the front wall 7 and having integrally formed therewith a handle 43. The other one of the cams 41 is rigidly mounted on a hub or bushing 44 that is journaled in a suitable opening in the wall member 12, in axial alignment with the shaft 42. The shaft 42, exterior of the housing wall 7, is provided with a radially outwardly projecting flange 45 having circumferentially spaced radially outwardly projecting portions 46 that normally overlie the head ends of mounting screws 47 that are utilized to secure the housing 6 to the inner surface of the door 1. The screws 47 are screw threaded into the inner end of a cylindrical body 48 contained within a transverse bore 49 in the door 1, in axial alignment with the shaft 42, the body 48 having formed therewith a handle 50 on the exterior side of door 1. The body 48 is also formed to receive a commercially available cylinder lock 51 that is held in place by an anchoring plate 52 and a pair of anchoring screws 53, see particularly FIG. 2. The cylindrical lock 51 is connected to the hub or bushing 44 by a cross-sectionally rectangular lock spindle 54, so that the cam 41 attached to the bushing 44 may be rotated from the exterior of the door by means of a key, not shown, inserted into the lock 51.

During unlocking movement of the handle 43 or cylinder lock 51, a cam follower 55, which engages both cams 41, is moved in a direction generally radially away from the common axis of the shaft 42 and spindle 54 against bias of a coil compression spring 56. The spring 56 has one end portion contained within a recess 57 in the cam follower 55, the other end of the spring 56 abutting the housing end wall 10. When either the handle 43 or cylinder lock 51 are released, the spring 56 is free to move the cam follower 55 toward the axis of the shaft 42, rotating the cams 41 to their neutral position shown in FIG. 3. A safety lock 58 is slidably mounted in a slot 59 in the housing front wall 7, and includes a lug portion 60 that is receivable within a notch 61 in the crossbolt 24 to rigidly hold the crossbolt 24 against movement away from its locked position by either the handle 43 or the cylinder lock 51. The safety lock 58 has secured thereto a leaf spring 62 formed to provide a detent that is receivably selectively in a pair of notches 63 in the housing wall 7 to releasably hold the safety lock 58 in a locking or unlocking position relative to the crossbolt 24.

As above noted, the coil compression spring 32 yieldingly urges the crossbolt 24 toward its locked position. Retaining means for releasably holding the crossbolt 24 in its unlocked position with the bolt portions 27 withdrawn from the notches 18, comprises an elongated actuator lever 64 having a hook-shaped inner end 65 pivotally mounted on a fulcrum pin 66 suitably mounted in the housing 6, see particularly FIGS. 3 and 4. Intermediate its ends, the actuator lever 64 is formed to provide a hook portion 67 defining a cam surface 68. The hook portion 67 is adapted to be received within a recess 69 in the crossbolt 24, the recess 69 having a hook-engaging surface 70 that extends transversely of the direction of movement of the latch bolt 24. A coil compression spring 71 urges the actuator lever 64 in a direction of its pivotal movement to move the hook portion 67 into the recess 69 of the latch bolt 24.

The actuator lever 64 includes an angularly displaced outer end portion 72 that projects outwardly of the housing 6 through an opening 73 in the nose portion 17 adjacent the top housing wall 8. As shown particularly in FIG. 4, the end portions 72 is disposed to engage the base portion 20 of the strike 19 upon final closing movement of the door 1 to move the actuator lever 64 against bias of the spring 71 in a direction to disengage the latch bolt 24 from the hook portion 67, thus permitting the spring 32 to move the latch bolt 24 into interlocking engagement with the strike lugs 22. As the crossbolt 24 moves to its locking position, the head 36 of the retainer member 34 moves from the surface 37 of the hub 38 and into engagement with the shoulder 39 thereof, thus positively locking the crossbolt 24 against movement away from interlocking engagement with the strike lugs 22.

When it is desired to open the door 1, assuming that the safety lock 58 is disengaged from the crossbolt 24, either of the cams 41 is rotated by means of the handle 43 or cylinder lock 51, in a direction to retract the retainer member 34 from engagement of the head thereof 36 from the shoulder 39, and thereafter to move the crossbolt 24 toward its unlocked position. As soon as the bolt portions 27 are retracted from their respective notches 18 out of interlocking engagement with the strike 19, the door may be opened. Immediately upon opening of the door, the actuator lever 64 is moved by its spring 71 to engage the surface 70 of the recess 69 by the hook portion 67. During unlocking and opening of the door 1, should the actuator lever 64 be moved by the spring 71 before the crossbolt 24 reaches it fully retracted position, the cam surface portion 68 of the hook portion 67 will be engaged by the adjacent end of the crossbolt body 25, so that the lever 64 will be moved by such engagement against bias of the spring 71 sufficiently to permit the crossbolt 24 to be moved into hooking engagement with the hook portion 67. Then, as soon as the door 1 is again closed, engagement of the outer end portion 72 of the actuator lever 64 with the base portion 20 of the strike 19 will cause the crossbolt 24 to be released for automatic movement into interlocking engagement with the strike lugs 22.

MODIFIED ARRANGEMENT

Figure 6:
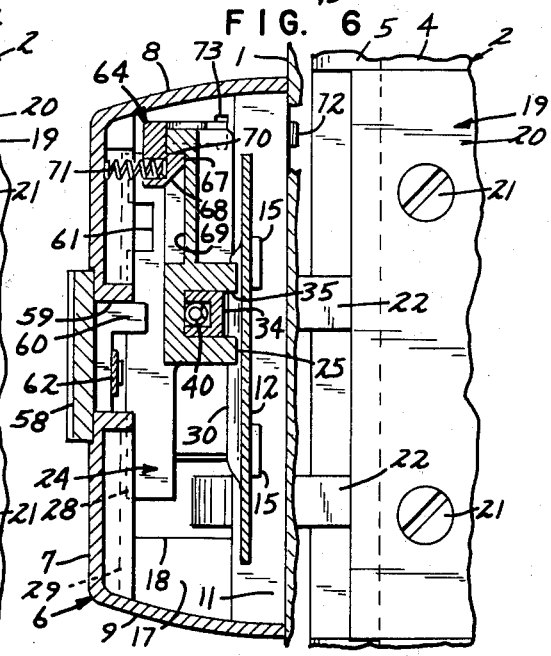
FIG. 6 is a view corresponding to FIG. 5 but showing a different position of some of the parts.
Figure 7:
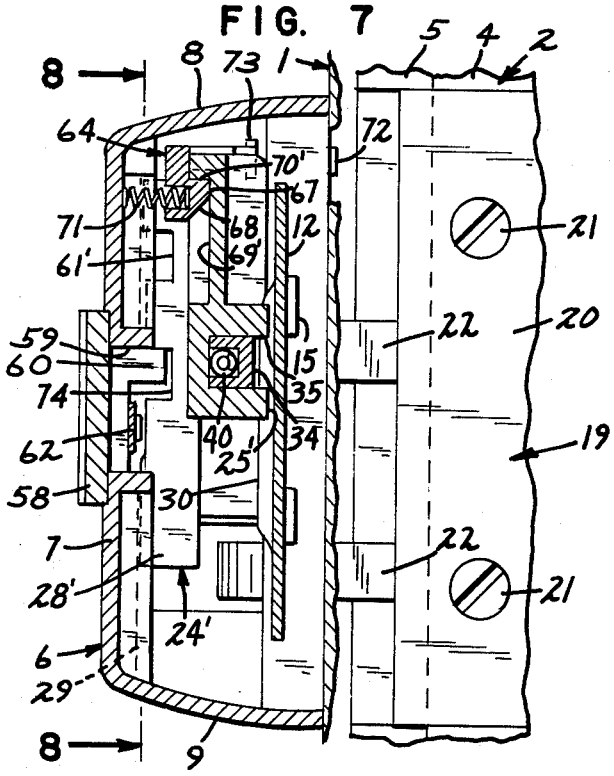
FIG. 7 is a fragmentary view corresponding to FIG. 6 but showing a modified form of crossbolt.
Figure 8:
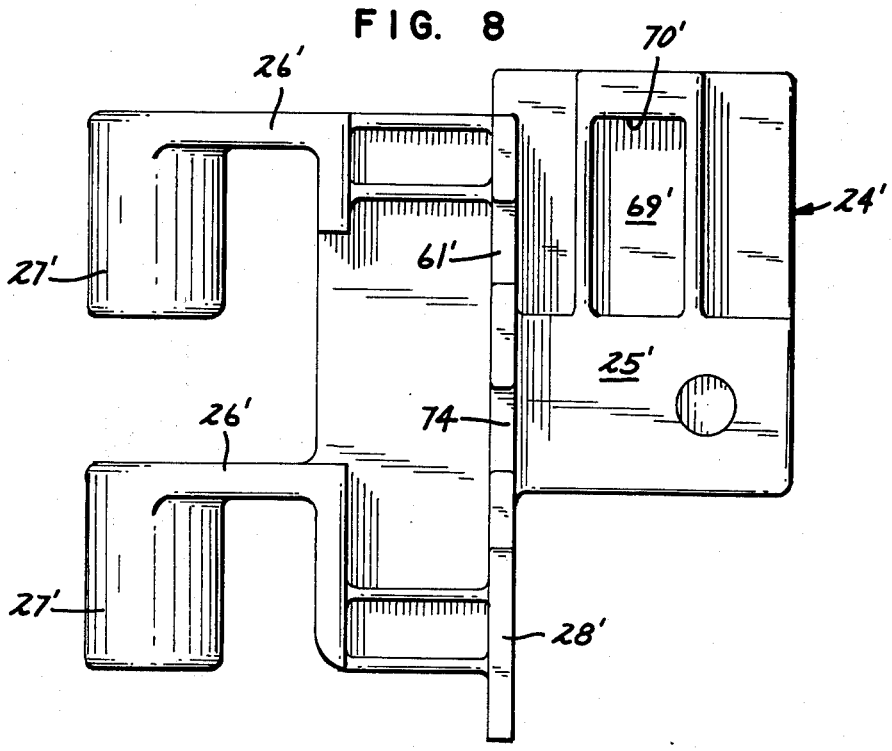
FIG. 8 is a view in side elevation of the crossbolt as seen from line 8—8 of FIG. 7, other parts being removed.

In the form of the invention illustrated in FIGS. 7 and 8, the parts therein shown, with the exception of the crossbolt, are identical to corresponding parts shown in FIG. 6, and are indicated by like reference numerals. The crossbolt shown in FIGS. 7 and 8 is indicated generally at 24' and differs only slightly from the crossbolt 24, those portions of the crossbolt 24' that are identical to the crossbolt 24 means indicated by the same reference numerals with prime marks added.

The crossbolt 24' differs from the crossbolt 24 in that the rail portion 28' is formed to provide a recess or notch 74 similar to the notch 61' and spaced therefrom in a direction longitudinally of the direction of movement of the crossbolt 24' within the housing 6'. The notch 74 is so disposed that, when the crossbolt 24' is in its unlocked or unlocking position of FIG. 7, the notch 74 is disposed to receive the lug portion 60 of the safety lock 58 when the safety lock is moved to one limit of its movement in the slot 59. Thus, the crossbolt 24' may be positively locked, not only in its locked or locking position, but in its unlocked or unlocking position. With this arrangement, the safety lock 58 cooperates with the notch 74 to provide an antilockout mechanism, so that a person may, by moving the safety lock 58 so that the lug portion 60 thereof may be received in the notch 74, permit the door 1 to close almost completely without having the crossbolt 24' automatically move to its locked or locking position.

While I have shown and described a commercial embodiment of my automatic locking crossbolt deadlock, and a modified form thereof, it will be understood that the same is capable of further modification without departure from the spirit and scope of the invention, as defined in the claims.

What is claimed is:

1. A crossbolt deadlock comprising:

a. a housing adapted to be mounted on a door hinged in a door frame, said housing defining notch means opening generally toward an adjacent portion of the door frame;

b. a strike adapted to be mounted on the door frame and having apertured lug means for reception in the notch means when the door is closed;

c. a crossbolt mounted in the housing for movements between locked and unlocked positions relative to the notch means and strike means;

d. yielding means urging said crossbolt to said locked position thereof;

e. means for moving the crossbolt to its unlocked position against bias of said yielding means;

f. an actuator lever in said housing for releasably holding said crossbolt in the unlocked position thereof, said lever extending in a direction transversely of the direction of movement of the crossbolt and having an inner end within said housing, an outer end projecting outwardly through an opening in said housing, and a crossbolt engaging portion intermediate its ends;

g. means pivotally mounting said inner end of the lever in said housing for swinging movements on an axis parallel to the direction of movement of the crossbolt toward and away from engagement of said crossbolt engaging portion with said crossbolt;

h. yielding means urging said lever in a direction of said swinging movement toward said crossbolt;

i. said outer end of the actuator lever being disposed to engage said strike responsive to closing of the door to move said lever in a direction to disengage the crossbolt engaging portion thereof from said crossbolt against bias of said yielding means;

j. said crossbolt engaging portion comprising a protuberance, said crossbolt defining a recess for reception of said protuberance and further defining a pair of notches spaced apart longitudinally of the direction of movement of said crossbolt between its locked and unlocked positions;

k. and a locking member mounted in said housing for movements in opposite directions transversely of the direction of movement of the crossbolt, said locking member having a portion receivable in said notches selectively to positively hold said crossbolt in said locked and unlocked positions selectively.

2. A crossbolt deadlock comprising:

a. a housing adapted to be mounted on a door hinged in a door frame and including a front wall disposed generally parallel to the plane of the door when said housing is mounted thereon, said housing defining notch means opening generally toward an adjacent portion of the door frame;

b. a strike adapted to be mounted on the door frame and having apertured lug means for reception in the notch means when the door is closed;

c. a crossbolt mounted in the housing for linear sliding movements between locked and unlocked positions relative to the notch means and said strike;

d. yielding means urging said crossbolt to said locked position thereof;

e. means for moving the crossbolt to its unlocked position against bias of said yielding means;

f. an actuator lever in said housing for releasably holding said crossbolt in the unlocked position thereof, said actuator lever extending in a direction transversely of the direction of movement of the crossbolt and having an inner end within said housing, an angularly displaced outer end projecting outwardly through an opening in said housing and toward the door frame when said housing is mounted on the door, and a crossbolt engaging portion intermediate its ends within said housing;

means pivotally mounting said inner end of the actuator lever to said housing for swinging movements on an axis parallel to said front housing wall and to the direction of movement of the crossbolt toward and away from engagement of said crossbolt engaging portion with said crossbolt;

h. spring means urging said actuator lever in a direction of said swinging movement toward said crossbolt;

i. said outer end of the actuator lever being disposed to abuttingly engage a portion of said strike spaced from said lug means responsive to closing of the door to move said actuator lever in a direction to disengage the crossbolt engaging portion thereof from said crossbolt against bias of said spring means;

j. said crossbolt engaging portion comprising a protuberance, said crossbolt defining a recess for reception of said protuberance and further having an elongated rail defining a pair of notches spaced apart longitudinally of the direction of movement of said crossbolt between its locked and unlocked positions;

k. and a locking member mounted in said housing front wall for movements in opposite directions parallel to said front wall and transversely of the direction of movement of the crossbolt, said locking member having a portion receivable in said notches selectively to positively hold said crossbolt in said locked and unlocked positions selectively.

* * * * *

UNITED STATES PATENT AND TRADEMARK OFFICE

CERTIFICATE OF CORRECTION

PATENT NO. : 4,063,765

DATED : December 20, 1977

INVENTOR(S) : Russell W. Waldo

It is certified that error appears in the above-identified patent and that said Letters Patent are hereby corrected as shown below:

Column 2, line 21, "partucularly" should be --particularly--.

Column 2, line 29, "projects outwardly" should be --projects laterally outwardly--.

Column 3, line 37, "cylindrical" should be --cylinder--.

Column 4, line 18, "portions" should be --portion--.

Column 4, line 67, "means" should be --mean--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*